US010280057B2

(12) United States Patent
Schuld

(10) Patent No.: US 10,280,057 B2
(45) Date of Patent: May 7, 2019

(54) AMMUNITION REPLICA BOTTLE OPENER

(71) Applicant: John M. Schuld, Milford, CT (US)

(72) Inventor: John M. Schuld, Milford, CT (US)

( * ) Notice: Subject to any disclaimer, the term of this patent is extended or adjusted under 35 U.S.C. 154(b) by 148 days.

(21) Appl. No.: 15/424,289

(22) Filed: Feb. 3, 2017

(65) Prior Publication Data

US 2017/0267509 A1 Sep. 21, 2017

Related U.S. Application Data

(60) Provisional application No. 62/310,298, filed on Mar. 18, 2016.

(51) Int. Cl.
*B67B 7/16* (2006.01)

(52) U.S. Cl.
CPC ..... *B67B 7/16* (2013.01)

(58) Field of Classification Search
CPC ..... B67B 7/16
USPC ..... 81/3.55
See application file for complete search history.

(56) References Cited

U.S. PATENT DOCUMENTS

| | | | | |
|---|---|---|---|---|
| 1,972,920 | A | 9/1934 | Deuse | |
| D141,816 | S | 7/1945 | Johnson | |
| D141,817 | S | 7/1945 | Johnson | |
| D268,987 | S * | 5/1983 | Smith | D9/504 |
| 4,945,639 | A * | 8/1990 | Kirby | B26B 29/025 30/151 |
| 5,169,305 | A | 12/1992 | Kess | |
| 5,267,494 | A * | 12/1993 | Waluda | E05B 19/00 81/3.09 |
| 5,361,652 | A | 11/1994 | Andina | |
| D403,562 | S | 1/1999 | Molaro | |
| D481,600 | S | 11/2003 | Cohen | |
| D546,657 | S | 7/2007 | Buening | |
| 7,980,180 | B2 | 7/2011 | MacDougall | |
| D660,113 | S * | 5/2012 | Bigelow | D8/38 |
| D676,297 | S | 2/2013 | Bigelow | |
| 8,434,410 | B2 | 5/2013 | AlSalem | |
| D703,016 | S | 4/2014 | Crane | |
| D736,046 | S | 8/2015 | Crane | |
| D739,195 | S | 9/2015 | Scharch | |
| D749,383 | S | 2/2016 | Crane | |
| 9,962,757 | B2 * | 5/2018 | Legge | B21C 1/26 |
| 9,995,561 | B2 * | 6/2018 | Padgett | F42B 5/313 |
| 2015/0007698 | A1 | 1/2015 | Crane | |

FOREIGN PATENT DOCUMENTS

| | | |
|---|---|---|
| CN | 202046858 | 11/2011 |

* cited by examiner

*Primary Examiner* — Hadi Shakeri
(74) *Attorney, Agent, or Firm* — Michael A. Blake

(57) ABSTRACT

An ammunition replica bottle opener comprising: a generally solid brass portion; a generally solid copper portion attached to the brass portion; a cut machined into the solid brass portion configured to remove caps from bottles. A method of manufacturing an ammunition replica bottle opening, the method comprising: supplying a solid billet brass bar; machining the solid billet brass bar a cartridge with desired dimensions and with a threaded end; machining a bottle cap cut into the cartridge; supplying a solid billet copper bar; machining the solid billet copper bar to the desired dimensions to form a bullet; machining a threaded hole into one end of the bullet; attaching the bullet to the cartridge via the threaded end and threaded hole.

7 Claims, 7 Drawing Sheets

$T_c = .057^{v}$

AMMUNITION REPLICA BOTTLE OPENER

CROSS-REFERENCES

This patent application claims the benefit of U.S. Provisional Patent Application No. 62/310,298 by inventor John M. Schuld entitled "BULLET REPLICA BOTTLE OPENER," filed on Mar. 18, 2016, and which provisional application is fully incorporated by reference herein.

TECHNICAL FIELD

The disclosed invention relates to a bottle opener, and more specifically to a bottle opener that has the appearance of ammunition.

BACKGROUND

When a person is thirsty for a beverage contained in a bottle, it is of paramount importance to be able to open the bottle as quickly as possible. Furthermore, it is imperative that whatever contrivance is being used to access such bottle be readily accessible to the user.

There are a variety of bottle openers on the market for the purposes of opening a bottle and removing a bottle cap, however, many of them feature limitations in either their operation or their style. Sometimes these limitations are in the form of the weight, shape, or size of the opener. Some bottle openers look generally like ammunition for a firearm, often a cartridge with a bullet. However, often when these bottle openers are made out of hollow ammunition casings, the portion of the bottle opener that attaches to a bottle cap can wear out very quickly, and can fail in as little as about 25 to about 100 bottle openings.

Thus, there is a need for a bullet replica bottle opener that overcomes the above and other disadvantages.

SUMMARY OF THE INVENTION

The invention relates to an ammunition replica bottle opener comprising: a generally solid brass portion; a generally solid copper portion attached to the brass portion; a cut machined into the solid brass portion configured to remove caps from bottles.

The invention also relates to a method of manufacturing an ammunition replica bottle opening, the method comprising: supplying a solid billet brass bar; machining the solid billet brass bar a cartridge with desired dimensions and with a threaded end; machining a bottle cap cut into the cartridge; supplying a solid billet copper bar; machining the solid billet copper bar to the desired dimensions to form a bullet; machining a threaded hole into one end of the bullet; attaching the bullet to the cartridge via the threaded end and threaded hole.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

Figure 1:
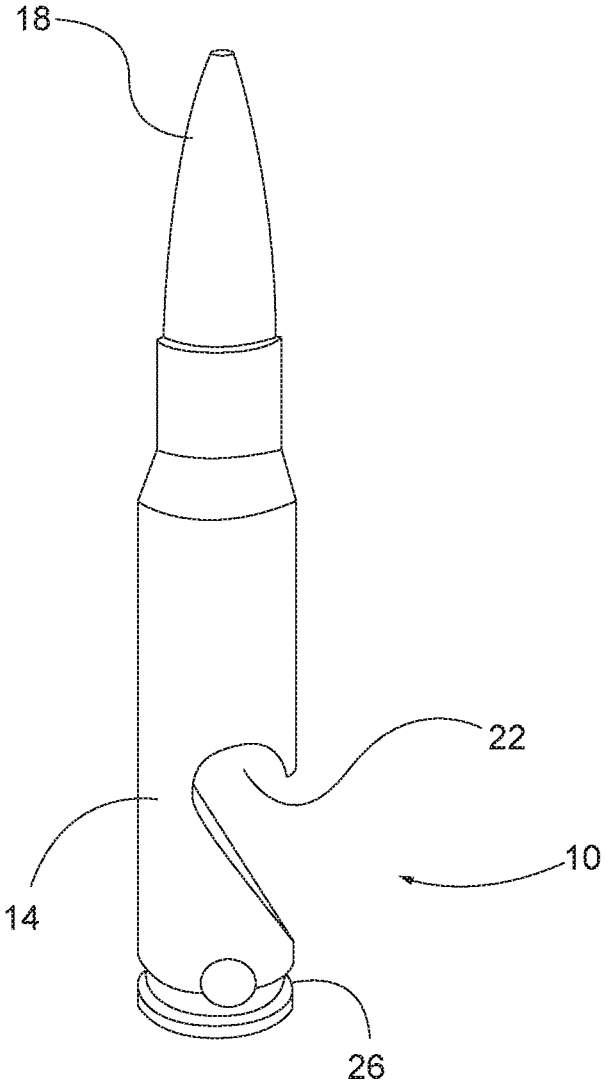
FIG. 1 is a perspective view of a bullet replica bottle opener.

FIG. 1 shows a perspective view of the ammunition replica bottle opener 10. In one embodiment, the opener 10 comprises a solid brass cartridge 14, and a solid copper bullet 18. In another embodiment, the bullet 18 may have an internal threaded opening to mate with a threaded portion from the brass cartridge 14. The brass cartridge 14 has a cut 22 configured to be able to pull the cap off of a beverage bottle, such as, but not limited to a soda bottle and beer bottle. A through-hole 26 may be drilled through the opener 10, in order to attach a chain, wire, key ring, necklace, etc.

Figure 2:
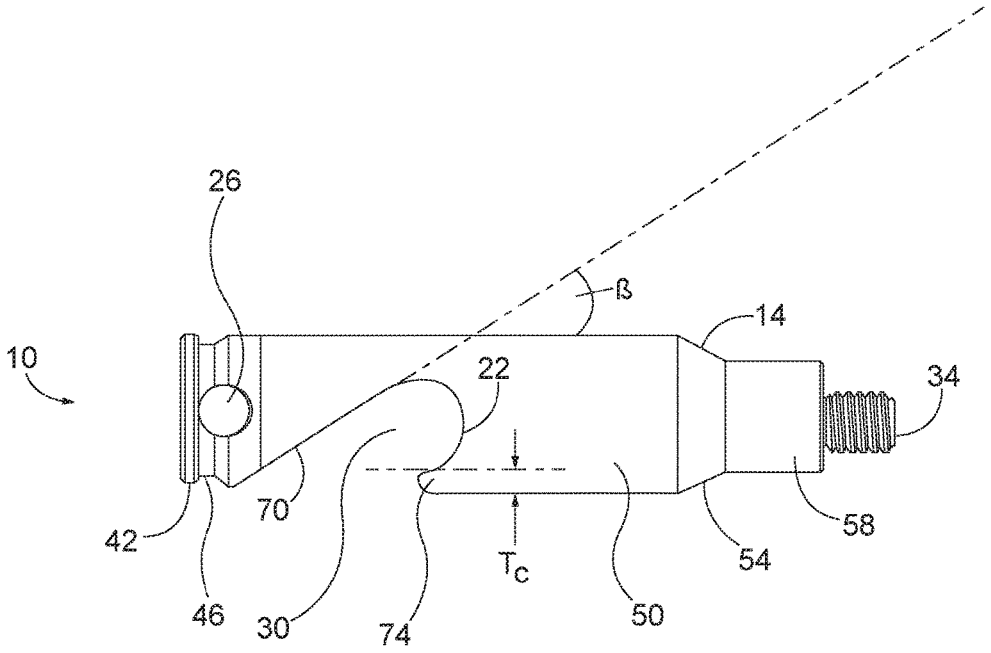
FIG. 2 is a front view of a bullet replica bottle opener.

FIG. 2 shows a front view of the cartridge 14 of the opener 10. In this view the through hole 26 is visible. Also, the cut 22 can be clearly seen in the cartridge 14. The cut comprises a generally cylindrical shape 30. The portion of the cut 22 used to pull of the cap, has a thickness $T_C$. $T_C$ may be about 0.02 inches to about 0.1 inches, and preferably about 0.057 inches. This thickness $T_C$, and the fact that the cartridge 14 is made out of solid brass, gives the opener 10 a great deal of material strength so that the opener 10 can be used many times without failing, up to about a 1000 times, or even to about several thousand times. In addition, in this view a threaded portion 34 has been machined out of the top end of the cartridge 14. The body has many of the components of a cartridge used for bullets. There is a rim portion 42, an extractor groove 46 adjacent to the rim portion 42 with a diameter generally less than the rim portion. A shoulder portion 54 adjacent to a body portion 50 of the cartridge 14. A neck portion 58 adjacent to the shoulder portion 50. The neck portion 58 may be at a smaller diameter than the body portion 50. The shoulder portion 54 may taper in diameter from generally the diameter of the body portion 50 to the diameter of the neck portion 58. The cut 22 may be formed by a generally planar surface 70 machined into the brass cartridge 14 at an angle β to the outer surface of the brass portion along a length of the brass portion, in addition a generally cylindrical shape 30 is machined into the brass portion 14 such that the axis of cylindrical shape 30 is parallel to the planar surface 70, and the planar surface 70 intersects with the cylindrical shape 30 or lies on a tangent of the cylindrical shape 30. A bottle opening member 74 is formed from the material between the cylindrical shape 30, and the outer surface of the brass portion 14 along a length of the brass portion 14, the thickness of the member being generally $T_C$.

Figure 3:
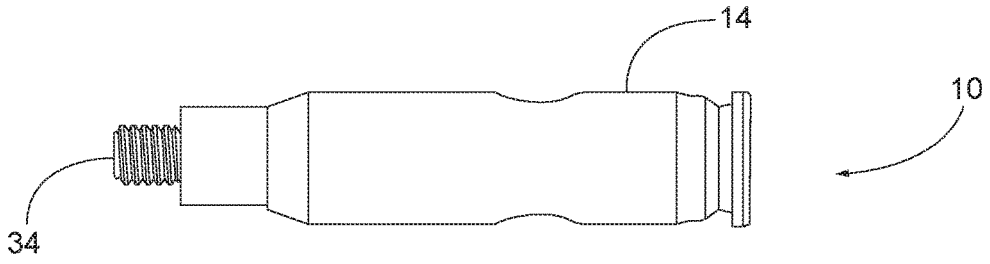
FIG. 3 is a side view of the bullet replica bottle opener from FIG. 2.

FIG. 3 is a side view of the cartridge 14 from FIG. 2.

Figure 4:
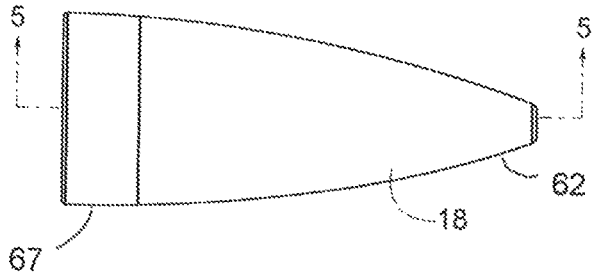
FIG. 4 is a side view of a bullet.

FIG. 4 is a side view of the bullet 18. The bullet 18 has a general bullet shape, that is front end 62 has a smaller diameter than the rear end 67, and may have a generally cylindroconical shape.

Figure 5:
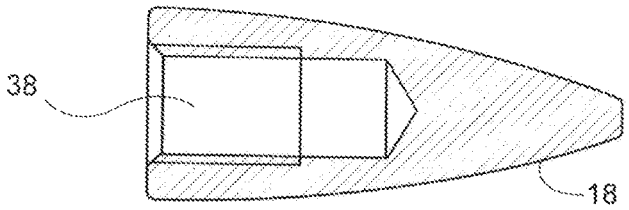
FIG. 5 is a cross-sectional view of a bullet.

FIG. 5 is a cross-sectional view of the bullet from FIG. 4. In this view, an internally threaded opening 38 configured to receive the threaded portion 34 is visible.

Figure 6:
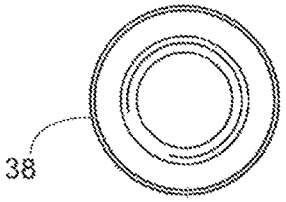
FIG. 6 is a top view of a bullet.

FIG. 6 is a top view of the bullet 18.

The disclosed replica bullet bottle opener may be made of a solid brass cartridge with a solid copper bullet. The solid cartridge and bullet make the opener far superior to and stronger than any other bottle openers that look like bullets currently available. The opener has a unique cut in its side allowing the bottle cap to fit in and to peel it off the bottle.

Figure 7:
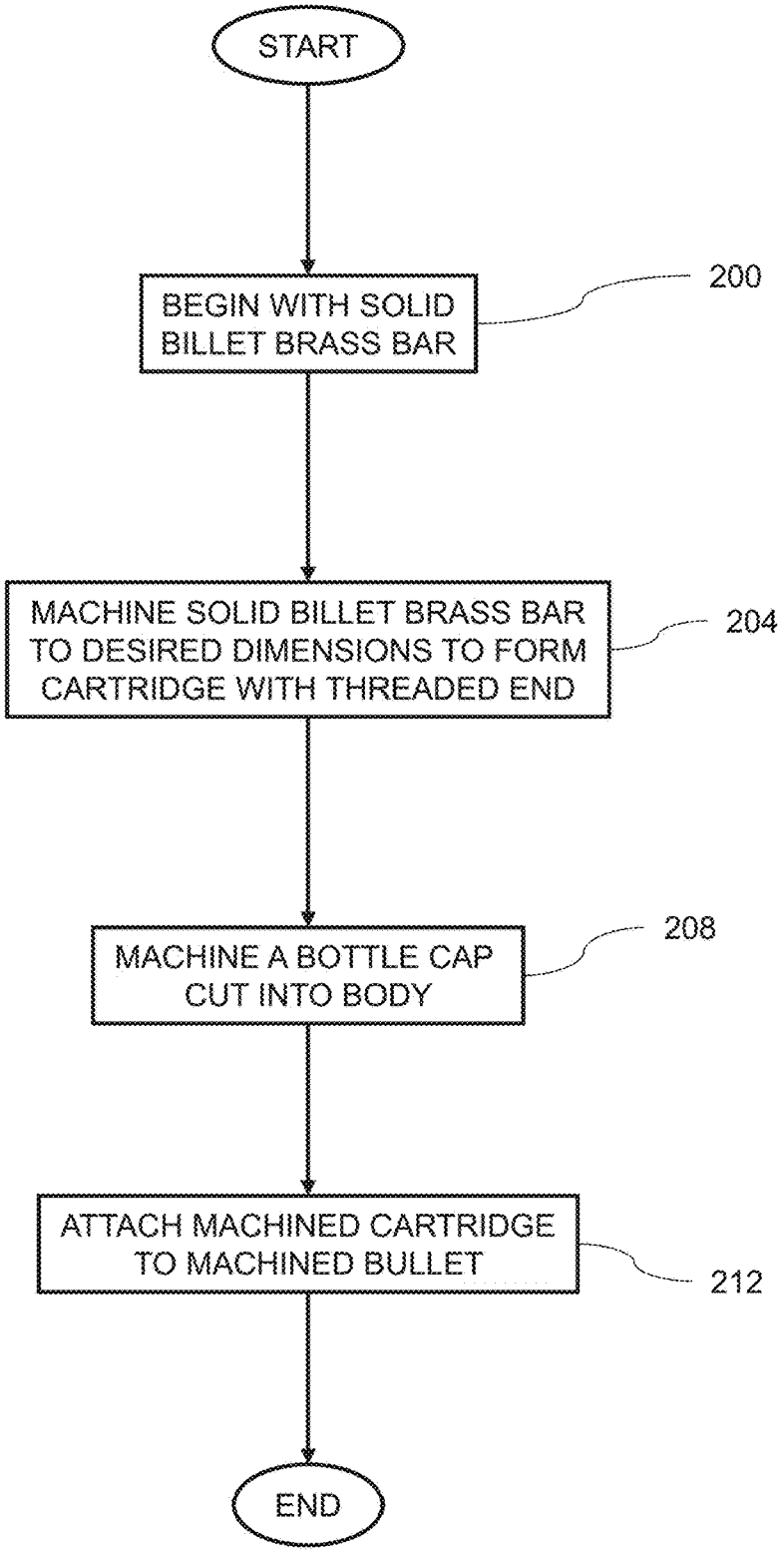
FIG. 7 is a flowchart illustrating a method of manufacturing the opener.

FIG. 7 shows a flowchart illustrating a method of manufacturing the cartridge 14. At act 200 the cartridge may start out as a 12' solid billet brass bar or rod. At act 204 the solid billet brass bar or rod may then be machined with precision machines into a cartridge with desired dimensions with a threaded end. At act 208 a bottle cap cut is machined into the cartridge. At act 212 the machined cartridge is attached to a machined bullet.

Figure 8:
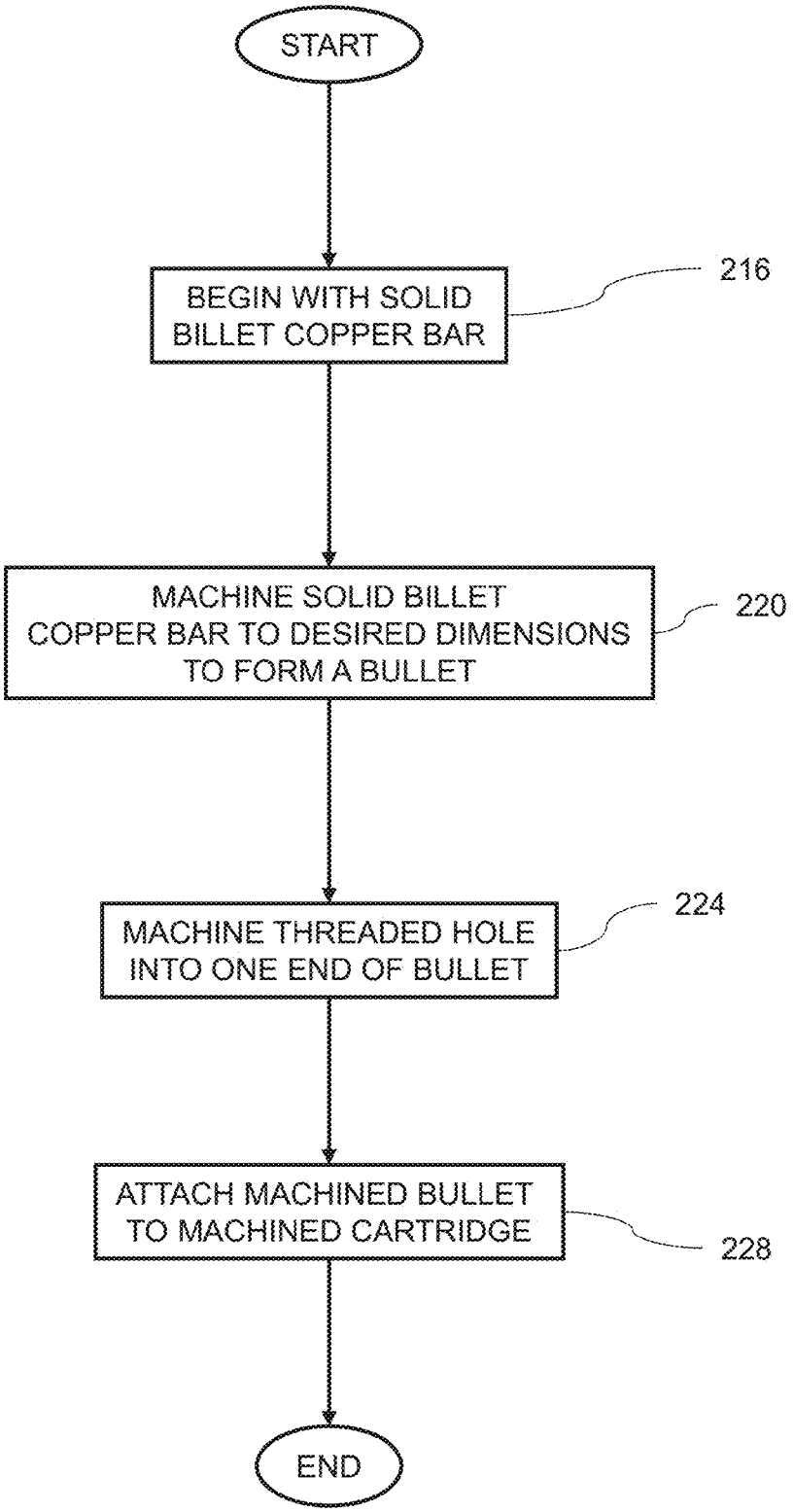
FIG. 8 is a flowchart illustrating another method of manufacturing the opening.

FIG. 8 shows a flowchart illustrating a method for manufacturing the bullet. At 216, one begins with a 12' solid billet copper bar or rod. At act 220, the solid billet copper bar or rod may be machined to the desired dimensions to form a bullet. At act 224, a threaded hole may be machined into one end of the bullet. At act 228 the bullet may be attached to the cartridge.

Figure 9:
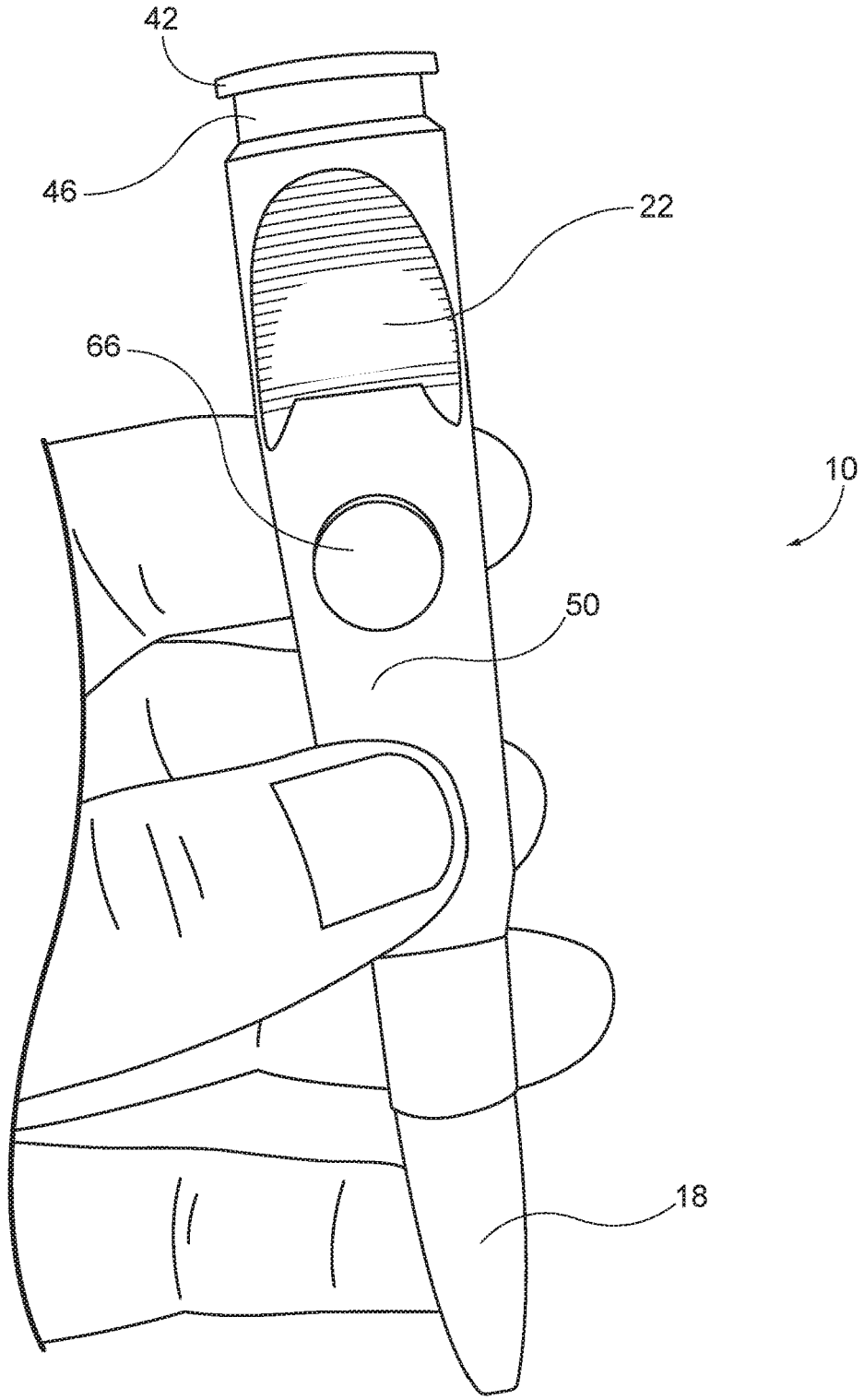
FIG. 9 is a front view of an opener with a magnet.

FIG. 9 shows a front view of another embodiment of the ammunition replica bottle opener 10. In this embodiment, a magnet 66 may be attached to the body portion 50 of the opener 10.

Figure 10:
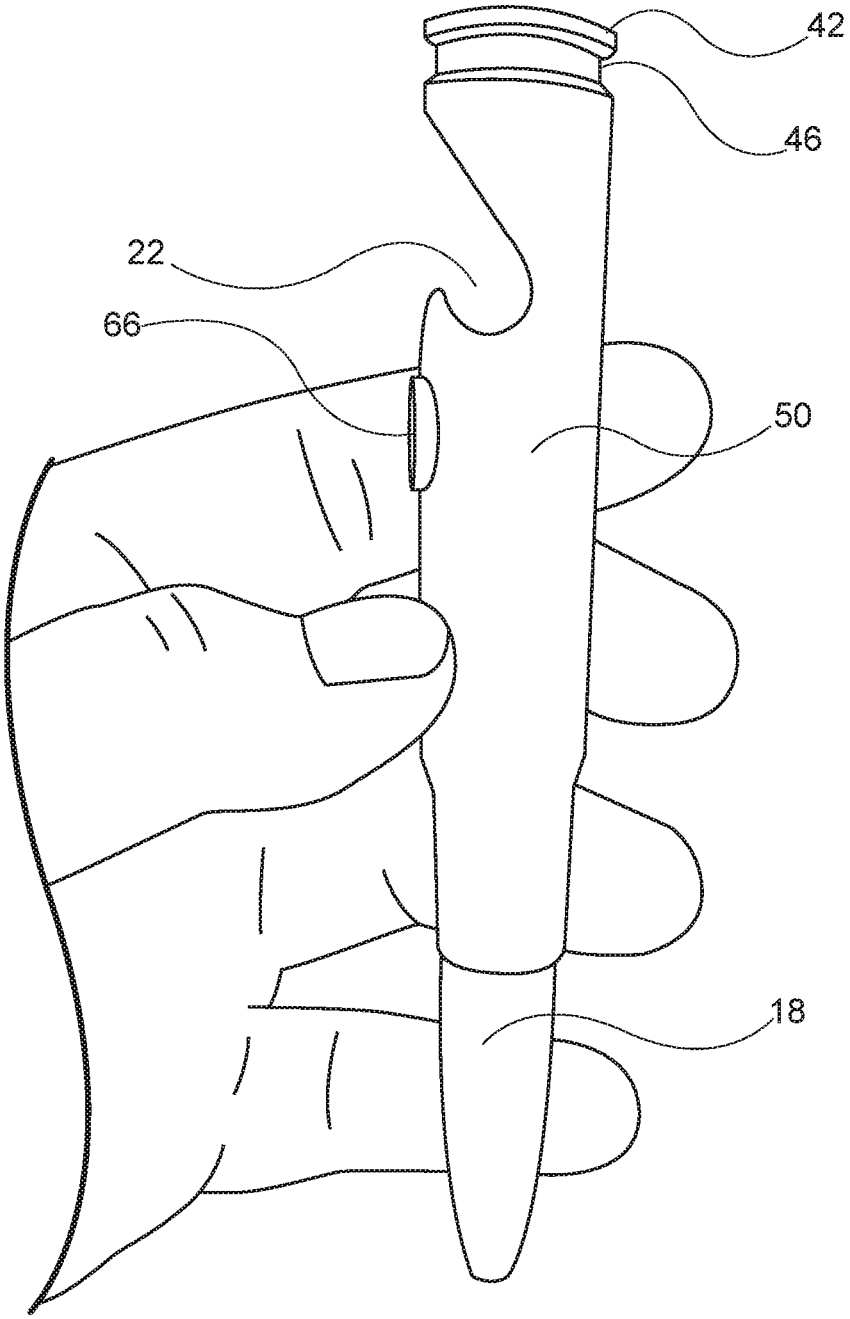
FIG. 10 is a side view of an opening with a magnet.

FIG. 10 is a side view of the opening 10 from FIG. 9. The magnet 66 may be used to removeably attach the opener 10 to any ferromagnetic surfaces, such as a refrigerator for example.

This invention has many advantages. It is stronger and lasts longer than bottle openers made out of hollow bullet casings, or hollow bullet cartridges. The cut in the body of the opener is configured to efficiently removeably attach to a cap of a bottle, and pull the cap off the bottle. The opener may have the appearance of many types of ammunition, including but not limited to 0.223 Remington cartridge, .308 Winchester cartridge, .50 Browning machine gun cartridge, 30 mm caliber round, other cannon rounds, bullets and cartridges. The opener may be used many times before failure.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. An ammunition replica bottle opener comprising:

a non-hollow brass portion, wherein the brass portion comprises:
- a rear end;
- a front end located on an end opposite of the rear end;
- a rim section located generally at the rear end;
- an extractor groove abutting the rim section, the extractor groove having a diameter smaller than the rim section;
- a body portion abutting the extractor groove, the body portion having a diameter greater than the extractor groove;
- a shoulder portion abutting the body portion; and
- a neck portion abutting the shoulder portion and located generally at the front end, the neck portion having a diameter smaller than the body portion, and the shoulder portion tapers from a larger diameter abutting the body portion to a smaller diameter abutting the neck portion;
- a threaded member extending from a front end of the neck portion;

a generally solid copper portion attached to the brass portion; and a cut machined into the solid brass portion configured to remove caps from bottles, wherein the brass portion is solid except for the cut.

2. The ammunition replica bottle opener of claim 1, further comprising a through-hole machined into the rear end of the solid brass portion, and wherein the solid brass portion is solid except for the through-hole and the cut.

3. The ammunition replica bottle opener of claim 1, wherein the solid copper portion is solid except for a threaded hole machined into one end of the solid copper portion.

4. The ammunition replica bottle opener of claim 1, wherein the solid copper portion comprises a threaded hole machined into one end of the solid copper portion configured to mate with the threaded member and wherein the solid copper portion is solid except for the threaded hole.

5. The ammunition replica bottle opener of claim 1, wherein the cut comprises a generally planar surface machined into the brass portion at an angle R to the outer surface of the brass portion along a length of the brass portion; a generally cylindrical shape machined into the brass portion such that axis of cylindrical shape is parallel to the planar surface, and the planar surface intersects with the cylindrical shape or lies on a tangent of the cylindrical shape; a bottle opening member formed from the material between the cylindrical shape, and the outer surface of the brass portion along a length of the brass portion, the thickness of the member being generally Tc.

6. The ammunition replica bottle opener of claim 1 configured to appear like ammunition selected from the group consisting of a 0.223 Remington cartridge, a .308 Winchester cartridge, a 0.50 Browning Machine Gun cartridge, and a 30 mm caliber round.

7. The ammunition replica bottle opener of claim 1 further comprising at least one magnet attached to an outer surface of the solid brass portion.

* * * * *